United States Patent [19]

Harmsen et al.

[11] Patent Number: 4,564,335

[45] Date of Patent: Jan. 14, 1986

[54] AXIAL FLOW FAN

[75] Inventors: Siegfried Harmsen; Georg F. Papst, both of St. Georgen; Günter Wrobel, Villingen, all of Fed. Rep. of Germany

[73] Assignee: Papst-Motoren GmbH & Co. KG, St. Georgen, Fed. Rep. of Germany

[21] Appl. No.: 718,832

[22] Filed: Apr. 2, 1985

Related U.S. Application Data

[63] Continuation of Ser. No. 466,642, Feb. 15, 1983, abandoned, which is a continuation-in-part of Ser. No. 140,883, Apr. 16, 1980, Pat. No. 4,373,861.

[51] Int. Cl.[4] ..... F04D 25/08; F04D 29/44

[52] U.S. Cl. ..... 415/213 C; 417/354

[58] Field of Search ..... 417/353, 354; 416/189, 416/192, 191, 201 A, 193 A, 213 A, 179, 183, 244 A, DIG. 3; 415/199.2, 199.4, 199.5, 181, 207, 212 R, 215, DIG. 1

[56] References Cited

U.S. PATENT DOCUMENTS

| | | | |
|---|---|---|---|
| 3,128,939 | 4/1964 | Szydlowski | 416/242 |
| 3,229,897 | 1/1966 | Papst | 417/354 |
| 3,334,807 | 8/1967 | McMahan | 416/242 |
| 3,362,627 | 1/1968 | Papst | 417/354 |
| 3,367,423 | 2/1968 | Van Ranst | 416/213 A |
| 3,378,192 | 4/1968 | Friese | 417/353 |
| 3,531,221 | 9/1970 | Herberg | 417/354 |
| 4,061,188 | 12/1977 | Beck | 416/189 |
| 4,128,364 | 12/1978 | Papst et al. | 417/354 |
| 4,166,310 | 9/1979 | Rothe et al. | 415/199.4 |
| 4,167,376 | 9/1979 | Papst | 417/354 |
| 4,225,285 | 9/1980 | Sturm | 415/213 C |

FOREIGN PATENT DOCUMENTS

| | | | |
|---|---|---|---|
| 1133676 | 4/1957 | France | 416/242 |
| 216489 | 9/1941 | Switzerland | 415/199.5 |

*Primary Examiner*—James C. Yeung

*Attorney, Agent, or Firm*—Fitch, Even, Tabin & Flannery

[57] ABSTRACT

An axial-flow fan comprising a fan wheel surrounded by a casing, the casing having a cylindrical flow passage in its axial central portion which is broadened at least toward the exhaust side by way of corner pockets into a regular multi-corner profile circumscribing the diameter of the fan wheel. The hub of the fan wheel is provided on the inlet side with an annular surface that reduces the outer diameter of the hub in the form of a conical configuration that faces the incoming air and which extends at least over one-third of the entire axial length of the hub.

21 Claims, 10 Drawing Figures

AXIAL FLOW FAN

This application is a continuation of application Ser. No. 466,642 filed Feb. 15, 1983, abandoned, which is a continuation-in-part of Ser. No. 140,883 filed Apr. 16, 1980, now U.S. Pat. No. 4,373,861, issued Feb. 15, 1983.

BACKGROUND AND SUMMARY OF THE INVENTION

The present invention relates to an axially compact axial-flow fan, especially a small-scale fan with a hub diameter of the fan wheel which is at least half as large as the inner diameter of the casing surrounding the fan wheel, which has a cylindrical configuration in its flow passage in the axial central portion and is broadened at least toward the exhaust side by way of corner pockets into a regular multi-corner, for example a square profile, circumscribing the diameter of the fan wheel.

Axial-flow fans of this type are conventional and known through U.S. Pat. No. 3,362,627. In the conventional types of construction, the hub of the fan wheel is fashioned as the motor casing to be essentially cylindrical, wherein the rotor of an external-rotor motor is disposed within this casing, the stator of this motor being mounted to a flange fixedly joined to the casing by way of spokes. Axial-flow fans of this type are primarily installed in electronic appliances to serve as ventilators, where the external dimensions of the casing jacket are predetermined such as by industry standards. On account of the small dimensions—the casing has predominantly square outside faces with a length of about 80 mm.—it is either impossible or possible only at very high expense, for reasons of electric motor technology and manufacturing techniques, to make the diameter of the motor housing smaller than corresponds to about two-thirds and, at the minimum, about one-half the internal diameter of the casing enclosing the fan wheel. This results in relatively small radial lengths for the blades, so that axial-flow fans of this type can hardly be improved upon any more in their efficiency with economical expenditure. Increasing the casing diameter is not possible because of the fixed dimensions. A speed increase leads to a rise in the noise level which in such axial-flow fans must likewise be kept at a minimum, and is furthermore possible only to a minor extent due to the given frequency of the power source.

Additionally, in the electronic appliances which are becoming increasingly more compact, the intake and exhaust chambers upstream and downstream of the axial-flow fans are exceedingly small so that such axial-flow fans frequently operate at very high counterpressures, resulting in reduced air flow rate.

An object of the present invention is to provide an axial-flow fan of the aforementioned type which avoids these disadvantages associated with the known fans and which, specifically, makes it possible to provide an increase in efficiency at least in a partial area of the characteristic output curve, without having to abandon the total concept or having to take complicated measures.

The invention resides in providing the hub of the fan wheel on the inlet side with an annular surface means extending at least over one-third of the entire axial length of the motor and being, for instance, of a conical configuration toward the hub's end face. This feature, which is known per se in axial-flow fans of a different type of construction and is utilized particularly in relatively large axial-flow fans, surprisingly produces the advantage, in conjunction with the special features of the casing design, that the novel axial-flow fan of the present invention provides a markedly larger pressure increase in the region of relatively low air flow rates, so that the fan in this operating range can convey, at higher counterpressures, a larger amount of air. Therefore, especially when installed in appliances of the kind mentioned in the foregoing and when operating, due to the compact structure thereof, against higher counterpressures, the novel axial-flow fan of the present invention is superior to the units known heretofore. In the remaining pressure and air flow range, the novel fan is at least equivalent, and has the further advantage that it produces the increased amount of air in the region of higher static pressures at a markedly lower noise level, which has been proven unequivocally by measuring the noise level with axial-flow fans of a conventional type of structure and with the novel arrangement when installed in a test chamber and operating against increased counterpressure.

It is advantageous to make the average or representative angle of the annular surface means with respect to the axial direction to be 10°–30°, preferrably about 20°, because in this case an inwardly oriented flaring portion of the inlet region is obtained on an order of magnitude maximal for the fan efficiency. It is also particularly advantageous to arrange only five or seven fan blades uniformly over the periphery of the hub fashioned as the motor housing, which blades may be suitably made of thin steel sheet and are conventionally welded onto the motor housing. If these fan blades are provided over the entire axial length of the motor housing in such a way that they also contact with their inner edges the zone of the inlet region, for instance the conical annular surface at the motor casing, then especially favorable efficiency values are obtained, which may be due to the fact that the free inlet cross section can be optimally enlarged because of the conical configuration of the motor casing, which is all the more true in relation with the very thin end faces of sheet steel fan blades.

These and other objects, features and advantages of the present invention will become more apparent from the following description when taken in connection with the accompanying drawings, which show, for purposes of illustration only, one embodiment and variations thereof in accordance with the present invention.

DETAILED DESCRIPTION OF THE DRAWINGS

Figure 1:
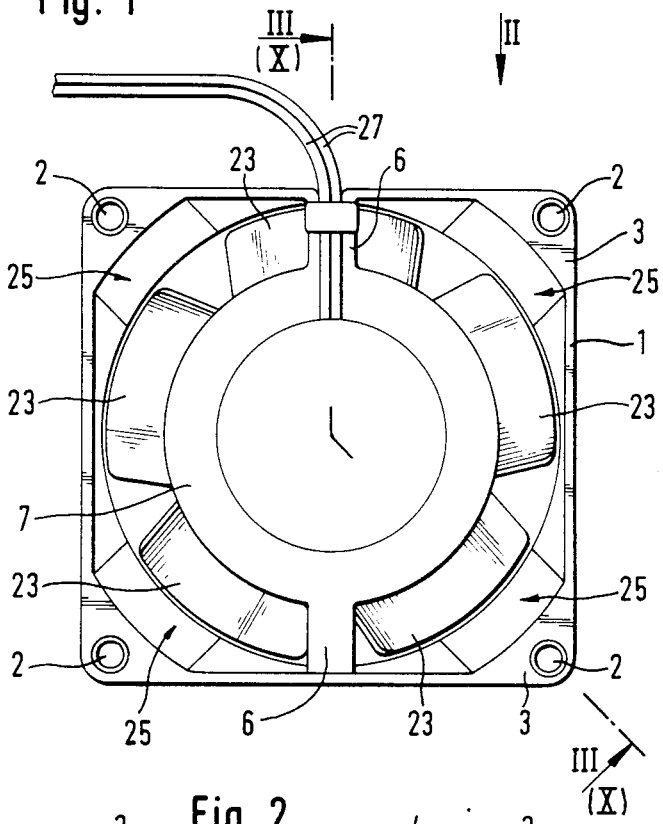
FIG. 1 is a schematic view of one embodiment of the novel axial-flow fan according to the present invention as seen from the exhaust side.
Figure 2:
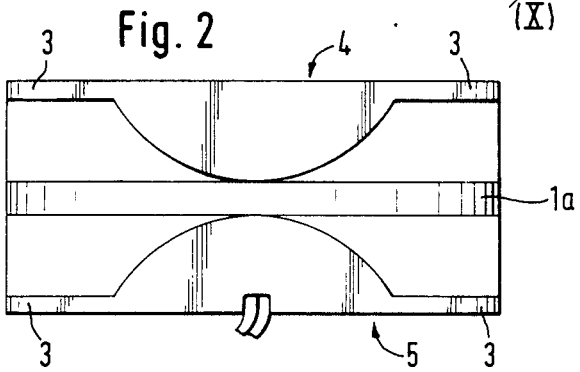
FIG. 2 is a top view of the fan of FIG. 1 as seen in the direction of arrow II in the figure.

FIGS. 1–2 show a casing 1 manufactured from die-cast aluminium or zinc-alloy or plastic for an axial-flow fan, having square outer dimensions and provided on the four corners respectively with mounting bores 2. The mounting bores 2 are arranged in corner flanges 3 extending beyond the casing, which casing is otherwise adapted to the cylindrical configuration. As can be seen from FIG. 3, such corner flanges 3 are arranged respectively on the inlet side 4 of the casing and on the outlet side 5. The casing 1 is equipped on the exhaust side 5 with two diametrically opposed struts 6 carrying a flange 7, the latter having been manufactured integrally with the casing 1. A pipe 10 is attached to the flange 7 by way of the screws 8 and via the auxiliary flange 9; the stator 11 with the coil winding heads 12 is attached to this pipe on its outside. The coil winding heads 12 are sealed toward the air inlet side by way of a cover cap 13 made of an insulating material, this cap engaging a ring 14, which is provided with a recess 15 toward the pipe. A ring 16 having the structure of a wick and containing a lubricant is inserted in this recess. This ring 16 adjoins toward the outside a second, angular lubricant ring 16', the inner diameter of which supplies a sliding bearing 17 with lubricant. With the aid of this bearing, the shaft 18 for the rotor of the electric motor is supported in casing 1. The shaft 18 is supported, in the zone of its end facing away from the inlet side 4, in a further sliding bearing 17 and abuts with its end face an axial bearing 19 provided in the flange 7. The motor housing 21 is fixedly joined to the shaft 18 via the bushing 20. On the outside, the motor housing is fashioned in one piece as a squirrel-cage motor, the bars of which extend conventionally through the laminated sheets 22 of the rotor. Five fan blades 23 uniformly distributed along the periphery and made of steel sheet are fixedly connected with the motor housing 21. These fan blades extend over the entire axial length of the motor housing 21, which latter is provided, in the zone toward the inlet side 4, with a conical annular surface 24 forming an angle $\alpha$ of 20° with respect to the axis of the shaft 18. This annular surface 24 exhibits an axial length 1 corresponding to about one-third of the total axial length L of the motor housing.

Figure 3:
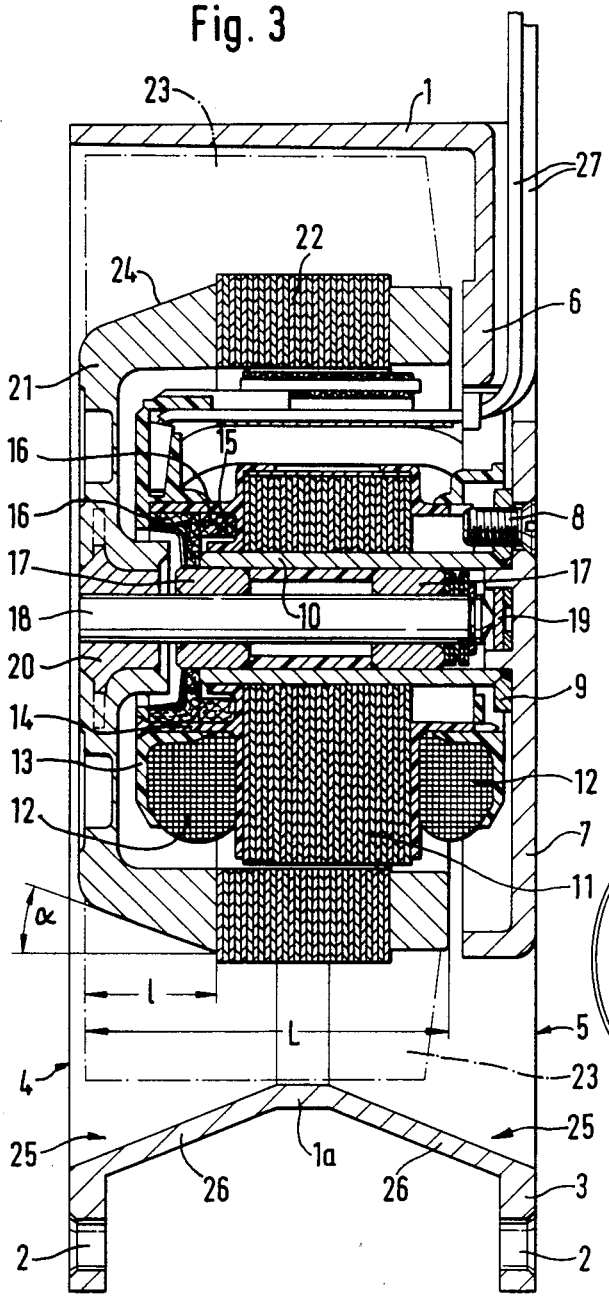
FIG. 3 is a section in an enlarged representation taken along the line III—III of FIG. 1.

By means of this arrangement, as can be seen particularly from FIG. 3, a broader inlet cross section is obtained over the entire inlet zone of the axial-flow fan. The front edges of the fan blades 23 extend into this cross section, since they are brought up approximately to the forward end face of the casing 1 with their front edges and contact, with their inner edges, the motor housing 21 also in the zone of the conical surface 24. The fan blades 23 are welded conventionally to the motor housing 21 by a special process (U.S. Pat. No. 3,431,978). Since they consist of very thin steel sheet, and only five fan blades are arranged distributed over the periphery, a very large free inlet region is obtained between the casing 1 and the motor housing 21 which is enlarged even more by the provision of the conical surface 24.

Since the casing 1, as can be seen from FIGS. 1 and 3, is provided, on the four diagonally opposite corners of the externally square casing 1, with corner pockets 25, the inclined wall sections 26 of which emanate from a central cylindrical middle piece 1*a*, the inlet cross section is additionally enlarged at these four corners. It has been found that an axial-flow fan constructed in this way has advantages over conventional kinds of construction especially if it must operate against higher pressures in the installed condition. In such a case, the fan yields surprisingly larger amounts of air.

The axial-flow fan is supplied with current by way of the two leads 27.

Figure 6:
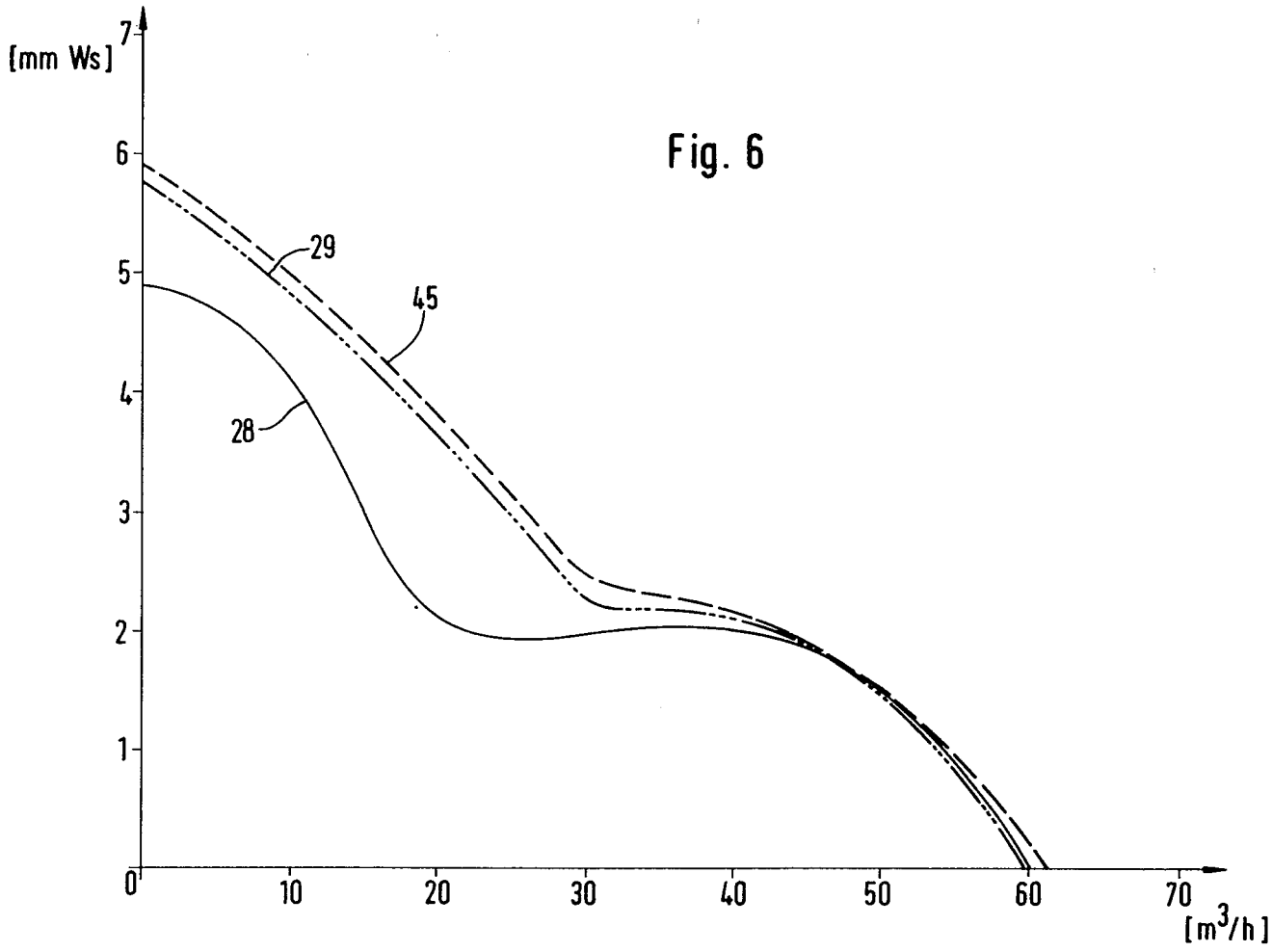
FIG. 6 is a schematic illustration of the curve of the air flow rate plotted over the static pressure, measured on two varied axial-flow fans according to the present invention and on an axial-flow fan according to the prior art.

FIG. 6 illustrates the characteristic curve of the novel axial-flow fan as compared with the characteristic curve of an axial-flow fan of the prior art (U.S. Pat. No. 3,362,627). It can clearly be seen that, at higher static pressures downstream of the fan and accordingly at a lower air flow rate, the novel axial-flow fan is clearly superior to the conventional types of construction. The characteristic curve 28 corresponds to the prior-art type of construction, whereas the characteristic curve 29 pertains to the novel axial-flow fan. The novel axial-flow fan therefore has advantages when installed for the ventilation of devices where there is only a limited amount of space available for installation.

It is also possible to arrange seven fan blades uniformly over the periphery of the motor housing 21 forming the hub of the fan wheel. It has been found that also advantages are attained in pressure increase in the zone of relatively small throughput volumes, and the noise level can be kept low.

We have so far shown and described only one embodiment in accordance with the present invention, and hereafter we show and describe another embodiment. It is understood that the invention is not limited to these embodiments but is susceptible of numerous changes and modifications as would be known to those skilled in the art, given the present disclosure we therefore do not wish to be limited to the details shown and described herein but intend to cover all such changes and modifications as are encompassed by the scope of the appended claims.

Figure 7:
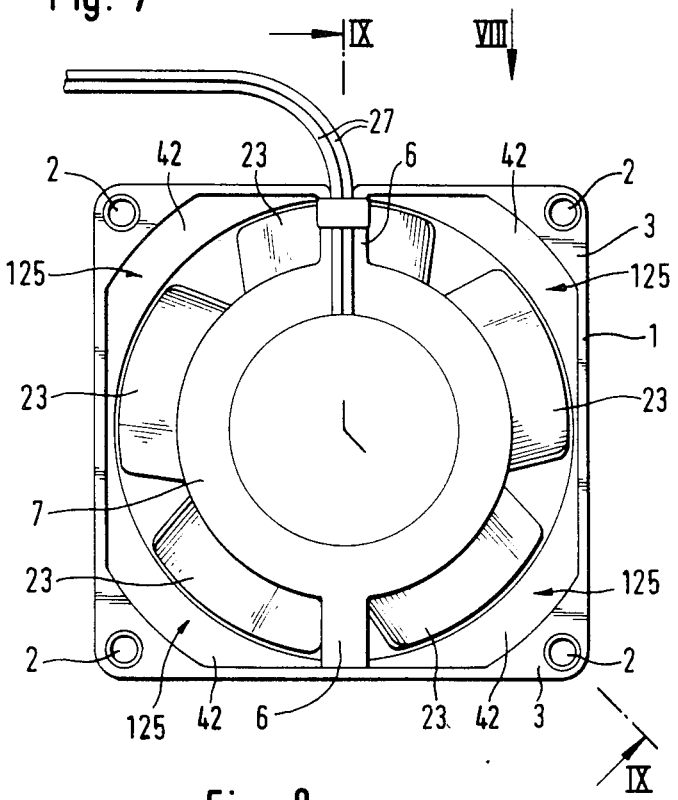
FIGS. 7 to 9 show a variation of the embodiment according to FIGS. 1 to 3.
Figure 8:
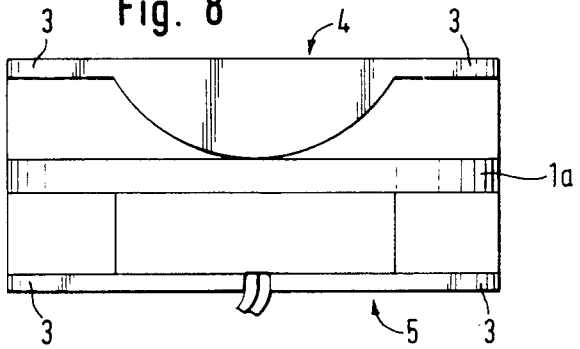
Figure 9:
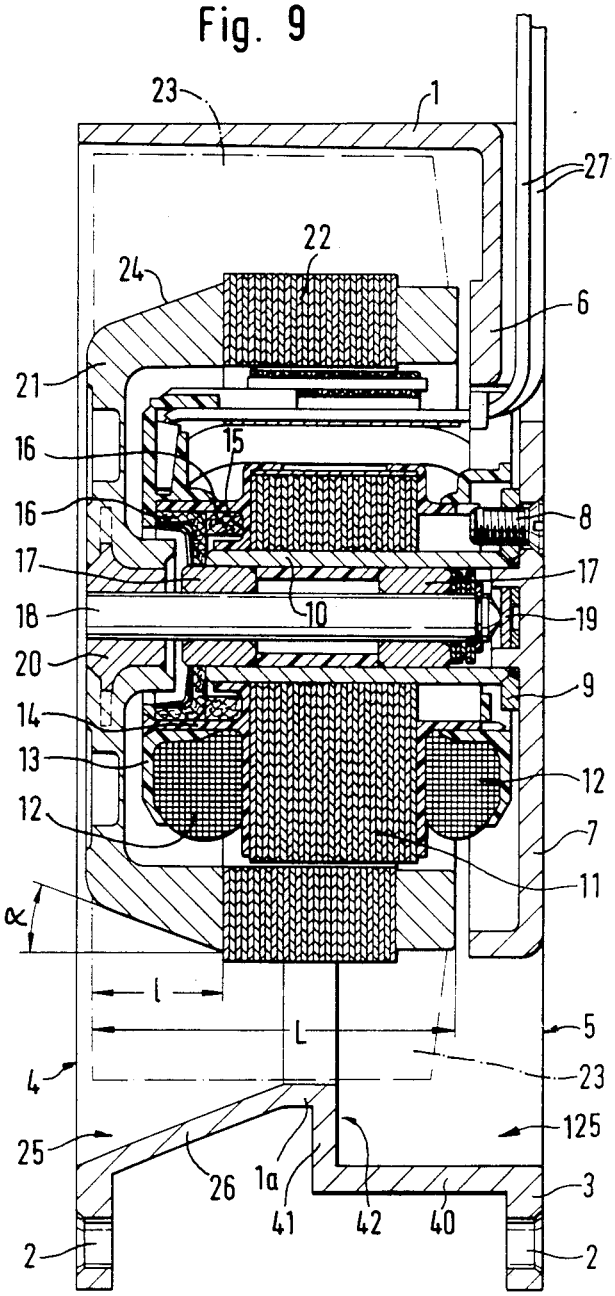

FIG. 6 shows a still further improved characteristic curve 45 for the embodiment according to FIGS. 7–9, which embodiment is achieved by having recessed portions on the exhaust side of the casing 1 by means of radially extending walls 41 in the region of the corner flanges 3. The characteristic curve 45 corresponds to a motor operated with a AC-voltage of 50 Hz. The improvement is still better when the motor runs at a higher speed, such as by operation with an AC-voltage of 60 Hz. In case of a DC-Motor the effect can be made still stronger as higher speed is available. So the walls 41 with radially extending planes 42 and the axial walls 40 constitute the corner pockets 125 in the form of recessed portions which are known per se as well as the flaring corner pockets of FIGS. 1 to 3. In the embodiment as shown in FIG. 9 the cylindrical flow passage is constituted by the central portion 1*a* of the casing 1. On the inlet side there are inclined walls 26 constituting the corner pockets 25 and on the exhaust side, there are recessed walls 40 and radial walls 41 constituting the pockets 125. The view of FIG. 8 is indicated by arrow VIII in FIG. 7, and the section view of FIG. 9 is indicated by arrows into the section line IX—IX in FIG. 7.

Figure 4:
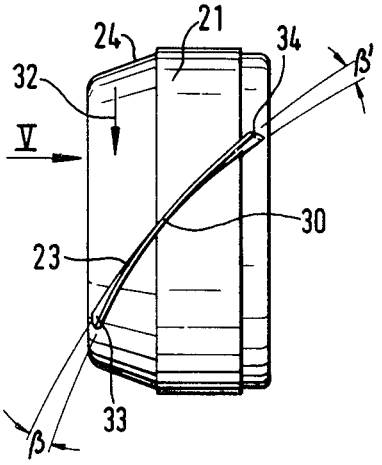
FIG. 4 is a top view of the motor casing constituting the fan rotor with a fan blade welded thereto.
Figure 5:
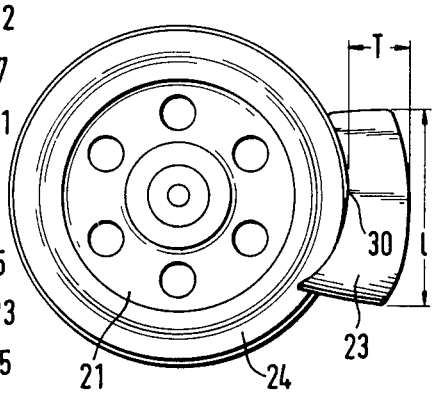
FIG. 5 is an elevational view of the motor casing in the direction of arrow V in FIG. 4.
Figure 10:
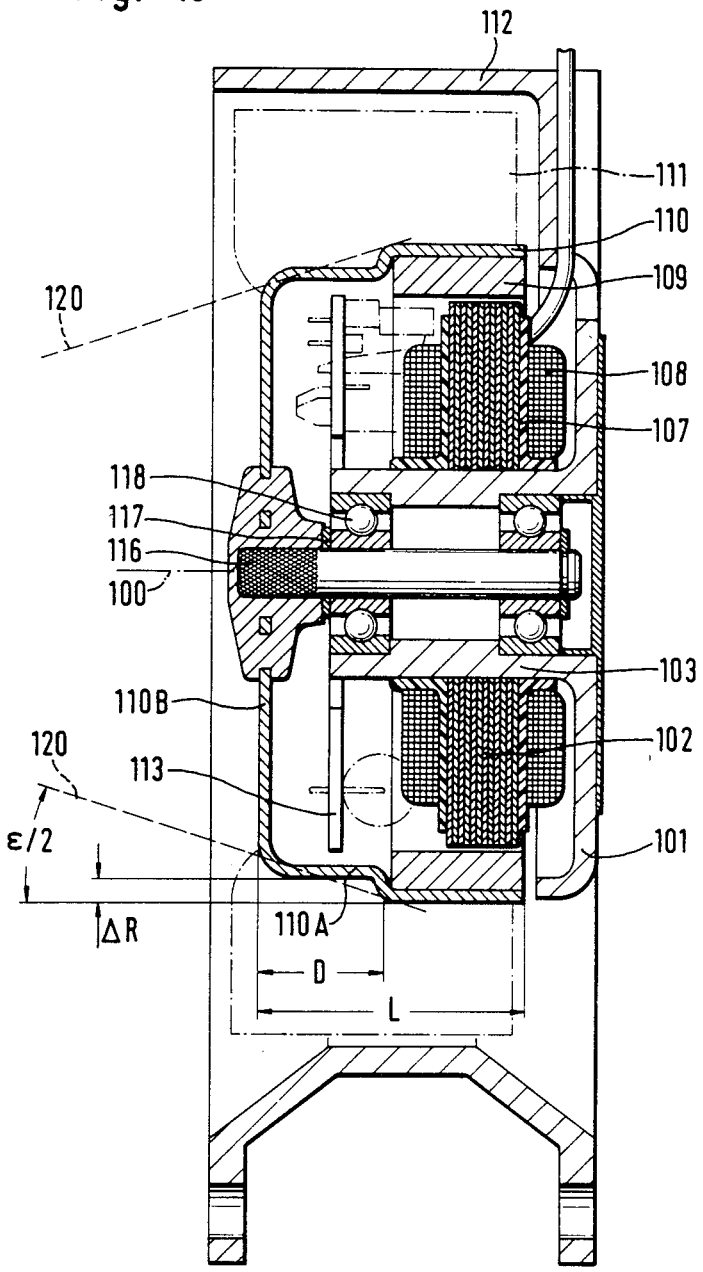
FIG. 10 shows a variation of the annular surface means at the inlet side at the rotor of FIG. 4 in a section view as in FIG. 3.

FIG. 10 shows a further embodiment by a variation of the conical shape of the rotor of FIG. 4 to be seen in a view similar to that of FIG. 3. Here the conical shape is achieved by a stepwise design by means of a cup-shaped outer-rotor-housing 110 manufactured as a deep drawn sheet steel. The natural size is about half the actual size of the drawing. On the inlet side at the bottom of the rotor cup over the axial length D the diameter of the outer rotor housing is reduced to the amount $2\times\Delta R$, which results in a flow effect similar as if there would have been a conical shaped hub with an enlargement angle $\epsilon$ of 20 to 60 degrees. The angle $\epsilon/2$ lies preferrably 40 degrees. The angle $\epsilon/2$ lies between rotational axes 100 and the equivalent cone indicated by dotted line with number 120. This embodiment has the following dimensions: D about 11 mm, $\Delta R$ about 2 mm, angle $\epsilon/2=17$ degrees. Thesteps at the end of the diametrically reduced part of the rotor housing are rounded with radius according $R1=3$ mm and according $R2=1.5$ mm. These rounded edges are beneficial for the flow behaviour. The housing casing of FIG. 10 is similar to that of FIG. 3, but the cylindrical flow passage of the wall corresponding to the wall 1*a* in FIG. 3 has about double the axial length. This axial length should not be reduced under a certain amount. The axial length L of the rotor is about 23 mm. The sheet metal of the rotor housing 110 is fixed for rotation with the shaft 116 by a small central hub welded on or diecast together with said shaft. A permanent magnet 109 for the rotor is inserted in its housing 110 to rotate therewith and to cooperate through the air gap with the windings 108 in the internal stator stack, the core 102 of which is opposite the permanent magnet 109 at the air gap. Circuit board 113 bears the electronic elements and is supported by the bearing tube which is cast together with the flange 101. Bearing tube 103 and flange 101 are one piece with the housing 112. The end shield 107 on one side of the stacked stator iron 102 may also support the circuit board, preferably a print with electronic elements to commutate the currents in the brushless DC-motor, driving the fan of FIG. 10. The blades 111 are welded on the sheet steel of the housing 110 according to U.S. Pat. No. 3,431,978 or may be substituted by a plastic fan wheel which hub may be fixed easily on the cylinder portion 110A with a reduced diameter and/or fixed on the plane bottom side 110B by adhesives or heat quenched fixing. The conical shape of the rotor may be distorted to a certain degree, however, because such a hub of the plastic fan wheel would reduce the cross-section of the flow passage just at the inlet side. That could be avoided by fixing the fan wheel only on the plane bottom side or bottom wall 110B This may be appropriate for inexpensive fans.

We claim:

1. An axially compact axial-flow fan comprising a fan wheel and a housing casing surrounding said fan wheel over at least substantially the entire axial length of said fan wheel, the fan wheel having a hub with a diameter which is at least half as large as the inner diameter of the housing casing, said housing casing having an inner axially extending cylindrical portion located in the axial central part and being broadened at least toward the exhaust side by way of corner pockets into a regular multicorner profile that circumscribes the diameter of the fan wheel, said hub of the fan wheel being provided on the inlet side with annular surface means that reduces the diameter on the inlet portion of said hub, said annular surface means extending at least over one-third of the entire axial length of said hub.

2. An axial-flow fan according to claim 1, wherein said annular surface means has a conical configuration toward the end face of said inlet side.

3. An axial-flow fan according to claim 2, wherein said conical configuration extends approximately over one-third of the entire axial length of said hub.

4. An axial-flow fan according to claim 2, wherein the angle of the annular surface with respect to the axial direction is about 20°.

5. An axial-flow fan according to claim 2, wherein said corner pockets are formed by inclined walls which extend from said central cylindrical portion.

6. An axial-flow fan according to claim 1, wherein said annular surface means has a cylindrical configuration toward the end face of said inlet side, the cylindrical surfaces being interrelated by stepwise reduced diameter toward said end face.

7. An axial-flow fan according to claim 6, wherein said cylindrical configuration extends approximately over one-half of the entire axial length of said hub and has a smaller diameter than said hub.

8. An axial-flow fan according to claim 1, wherein said regular multicorner profile is a square profile.

9. An axial-flow fan according to claim 1, wherein an odd number of fan blades are arranged in uniform distribution over the periphery of the hub.

10. An axial-flow fan according to claim 9, wherein the hub is part of a motor housing of an external rotor motor of the fan and wherein said fan wheel comprises fan blades formed of thin steel which are welded to the motor housing.

11. An axial-flow fan according to claim 9, wherein the hub is part of a motor housing of an external rotor motor of the fan and wherein said fan wheel comprises fan blades which extend over the entire axial length of the motor housing and contact with their inner edges the motor housing in the zone of the conical annular surface.

12. An axial-flow fan according to claim 11, said fan blades in their axial central part having an essential radial straight contour, perpendicular to the axis of rotation and the upstream part of said blade being inclined in its radial form in the direction of rotation, the down stream part of said blade being inclined in its radial form opposite the direction of rotation.

13. An axial-flow fan according to claim 12, said fan blades having a ratio of their average radial dimension to their axial over-all length of about 1 to 4.

14. An axial-flow fan according to claim 1, wherein said fan is a small-scale fan with the outside faces of said square profile each having a length between 60 to 100 mm.

15. An axial-flow fan according to claim 14, said length being on the order of 80 mm.

16. An axial-flow fan according to claim 1, wherein the hub is part of a motor housing of an external-rotor motor of the fan.

17. An axial-flow fan according to claim 1, wherein said corner pockets are formed by inclined walls which extend from said central cylindrical portion.

18. An axial-flow fan according to claim 1, wherein said corner pockets are formed by radially stepwise recessed portions which extend from said central cylindrical portion toward the exhaust side of the fan.

19. An axially compact axial-flow fan comprising a fan wheel and a housing casing surrounding said fan wheel over at least substantially the entire axial length of said fan wheel, said housing casing having an inner cylindrical passage of circular cross-section in the axial central portion and said cylindrical passage being broadened at least toward the exhaust side into a regular multicorner profile circumscribing the diameter of the fan wheel, said housing casing having at least one other portion directly connected to and rigid with said central portion providing a passage axially aligned and directly communicating with said cylindrical passage of said central portion, said passage of the other portion having an open end axially spaced from said cylindrical passage and having throughout its length and at said open end thereof a cross-sectional area greater than the cross-sectional area of said cylindrical passage and a transverse dimension greater than the diameter of said cylindrical passage, and an inner concentric part on the inlet side that is provided with annular surface means having a conical configuration toward the end face of said inlet side.

20. An axial-flow fan according to claim 19, wherein said hub of the fan wheel is provided on the inlet side with annular surface means that reduces the diameter on the inlet portion of said hub, said annular surface means extending at least over one-third of the entire axial length of said hub.

21. An axial-flow fan according to claim 19, wherein said fan wheel has a hub with a diameter which is at least half as large as the inner diamaeter of the housing casing.

* * * * *

UNITED STATES PATENT AND TRADEMARK OFFICE

CERTIFICATE OF CORRECTION

PATENT NO. : 4,564,335

DATED : January 14, 1986

INVENTOR(S) : Harmsen et al.

It is certified that error appears in the above-identified patent and that said Letters Patent is hereby corrected as shown below:

Col. 5, Line 7, change "degrees. The angle $\varepsilon/2$ lies" to --degrees,--.

Col. 5, Line 12, change "Thesteps" to --The steps--.

Col. 6, Line 4, change dependency from "2" to --3--.

Signed and Sealed this

*Third* Day of *June 1986*

[SEAL]

*Attest:*

DONALD J. QUIGG

*Attesting Officer*

*Commissioner of Patents and Trademarks*